United States Patent [19]

Landgraf

[11] 4,173,880

[45] Nov. 13, 1979

[54] COOLED MANDREL

[75] Inventor: Helmut Landgraf, Duisburg, Fed. Rep. of Germany

[73] Assignee: Mannesmann Aktiengesellschaft, Dusseldorf, Fed. Rep. of Germany

[21] Appl. No.: 894,024

[22] Filed: Apr. 6, 1978

[30] Foreign Application Priority Data

Apr. 7, 1977 [DE] Fed. Rep. of Germany ..... 2716315

[51] Int. Cl.[2] ..... B21B 25/04

[52] U.S. Cl. ..... 72/201; 72/208

[58] Field of Search ..... 72/97, 199, 201, 208, 72/209, 236; 165/89, 90

[56] References Cited

U.S. PATENT DOCUMENTS

| | | | |
|---|---|---|---|
| 2,650,034 | 8/1953 | Wiemer | 72/201 |
| 2,972,472 | 2/1961 | Konold | 165/89 |
| 3,135,319 | 6/1964 | Richards | 165/89 |
| 3,604,237 | 9/1971 | Kawanami et al. | 72/201 |
| 4,019,846 | 4/1977 | Greenberger | 72/201 |

FOREIGN PATENT DOCUMENTS

| | | | |
|---|---|---|---|
| 2331989 | 1/1975 | Fed. Rep. of Germany | 72/209 |
| 1272096 | 8/1962 | France . | |
| 1333956 | 10/1973 | United Kingdom | 72/209 |
| 398299 | 2/1974 | U.S.S.R. | 72/201 |

*Primary Examiner*—E. M. Combs

*Attorney, Agent, or Firm*—Smyth, Pavitt, Siegemund, Jones & Martella

[57] ABSTRACT

An internally cooled mandrel is provided with regularly arranged copper fingers projecting into the inner flow space and leaving a recess adjacent the outer surface which is filled with buildup. These fingers are arranged in axial rows in which the pins are staggeredly positioned.

8 Claims, 4 Drawing Figures

COOLED MANDREL

BACKGROUND OF THE INVENTION

The present invention relates to an internally cooled mandrel for rolling mills of pipes of relatively large wall thickness, and more particularly, the invention relates to a mandrel for use in Pilger type rolling mills.

A mandrel of the type to which the invention refers is, for example, disclosed in French Pat. No. 1,272,096. It was found that these known mandrels pose difficulties if used in conjunction with rolling thick-walled hollows. German printed patent application No. 2,331,989 discloses building up of hard-facing sleeves on a mandrel to be used for the rolling of hollows. These sleeves are plugs which match the surface of the mandrel locally to particular local loads. This cladding process employs highly alloyed materials.

DESCRIPTION OF THE INVENTION

It is an object of the present invention to provide a new and improved construction for internally cooled mandrels to be used in mills for rolling hollows, the improvement relating particularly to the temperature distribution between inner and outer surface of the mandrel so that the outer surface of the mandrel can be more effectively cooled.

In accordance with the preferred embodiment of the present invention, it is suggested to provide a tubular, thickwalled mandrel with solid, radial cooling fingers made of highly thermally conductive material such as copper. These cooling fingers are to be distributed all around the mandrel, over its entire extension and over its entire circumference; portions of these cooling fingers adjacent to the outer surface of the mandrel are covered by welded-on, hard-facing plugs for local cladding. Preferably, buffer layers are provided between the copper fingers and the cladding; the buffer is preferably comprised of an alloy with a significant portion of nickel or a nickel-copper alloy. The fingers are preferably widened closer to the outer surface of the mandrel. Preferably, one will arrange these fingers in rows, extending axially but being staggered azimuthally. The fingers will preferably project into the interior of the hollow mandrel to enhence contact with cooling fluid.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a hollow mandrel for use in a tube rolling mill, and the figure illustrates particularly a portion of the wall 1 of such a mandrel. The mandrel is provided with bores 2, which penetrate the wall and extend radially. Individual cooling fingers 3 are inserted in the bores. These fingers 3 are substantially cylindrical, elongated pins, made of copper. The bore 2 in wall 1, shown representatively in FIG. 1, is widened close to the outer surface 11 of the mandrel in order to accommodate a widened head 4 of, and being integral with, the cooling finger 3. The head 4 has a conical transition or shoulder 5 which rests against a correspondingly conical shoulder of bore 2.

Figure 1:
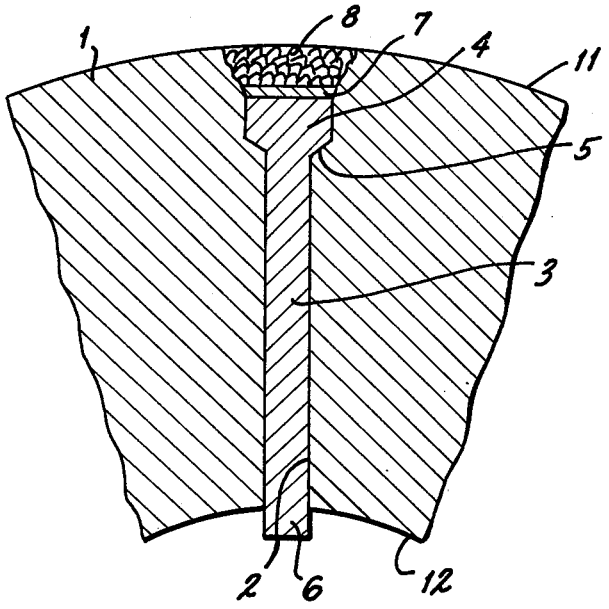
FIG. 1 is a cross-section through a portion of a rolling mandrel with cooling fingers inserted in accordance with the preferred embodiment of the present invention.

The head 4 ends short of the outer surface 11 of the mandrel and the resulting recess has been filled by welding with hard-facing or building-up type substance to establish a local cladding 8. The cladding plug 8 is flush with the outer surface 11 of the mandrel. The material for this particular cladding is, for example S—NiCr15FeMn (DiN 1736). For reasons of improved strength and improved interfacing, a nickel-copper alloy buffer layer 7 is interposed between the cladding plug 8 and the head 4 of finger 3.

As far as the internal space of the hollow mandrel is concerned, the inner end 6 of finger 3 is not flush with the internal surface 12, but projects into that hollow space circumscribed by the surface 12. This way, one ensures better and more intimate contact of and by the cooling fingers with the coolant flowing through that interior of the tubular mandrel.

Figure 2:
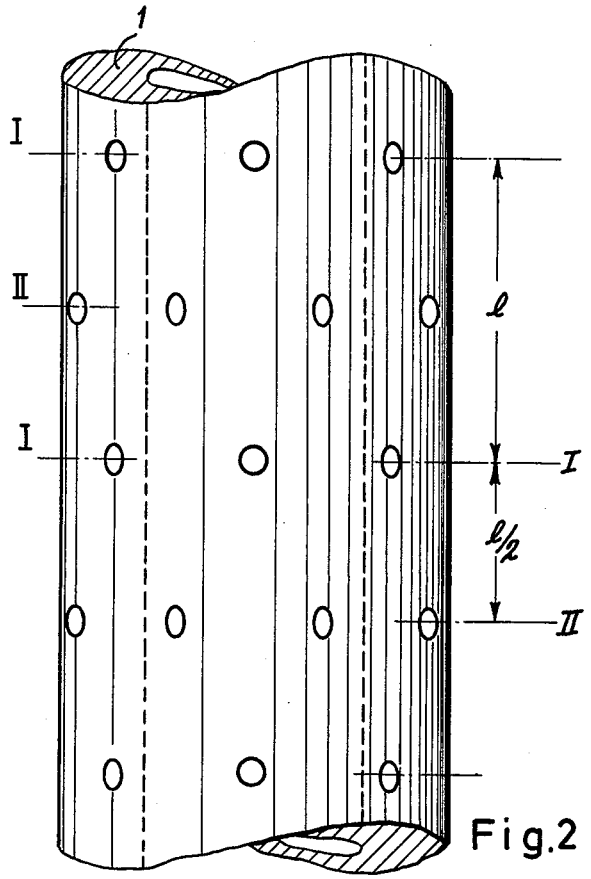
FIG. 2 is a portion of an elevation of a mandrel constructed in accordance with the preferred embodiment.
Figure 3:
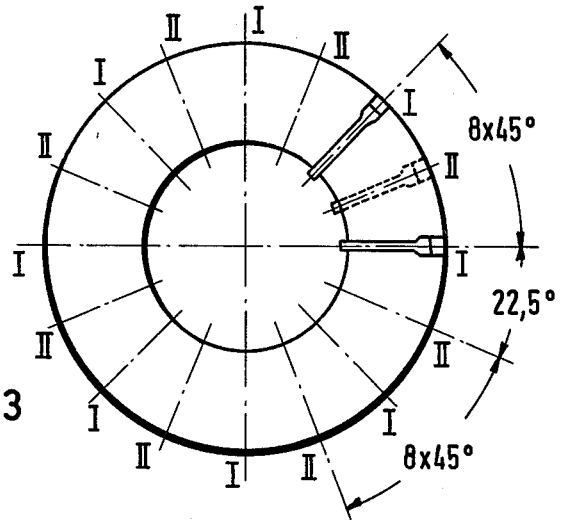
FIG. 3 is a cross-section taken in any of the planes I indicated in FIG. 2.

Turning now to FIGS. 2 and 3, one can see how these particular fingers and bores are arranged on and in the mandrel. One can see that the fingers are arranged in axial rows and are spaced from each other by a particular distance l. There are altogether sixteen such rows, and these rows are azimuthally spaced by an angle of 22.5°. However, the fingers and bores receiving these fingers are staggeredly arranged, so that in any particular plane transversely to the axis of the mandrel and traversing at least one such pin, altogether 8 pins are present being angularly spaced by 45°.

Figure 4:
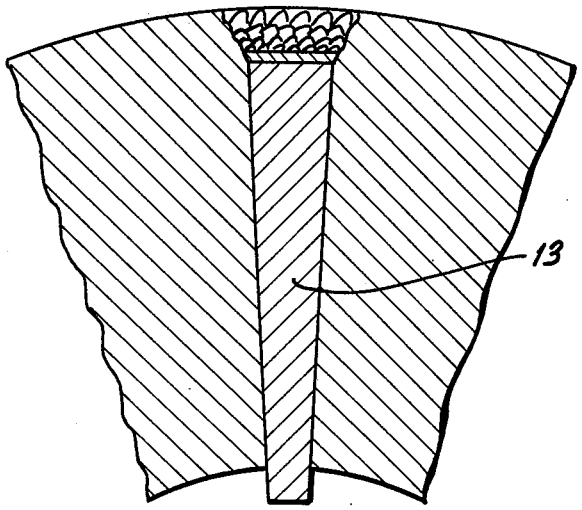
FIG. 4 is a view similar to FIG. 1, but showing a modified cooling finger.

Axial planes are identified by I and II in FIG. 2. It can readily be seen that the planes I are axially spaced-apart by the axial pin distance l within one row, and the pattern of pins in cross-section is repeated exactly, i.e. in axial alignment, in sequential ones of such planes I, while, on the other hand, the interspaced planes II show the respective pins angularly displaced by the 22.5° with respect to the pins as arranged in plane I. Planes I and II alternate, of course, at an axial spacing of l/2. The pins or cooling fingers 13 could have a tapered or concical configuration in lieu of the head as is illustrated in FIG. 4. The bores, of course, will be inwardly tapered in that instance.

The invention is not limited to the embodiments described above but all changes and modifications thereof not constituting departures from the spirit and scope of the invention are intended to be included.

I claim:

1. A thick-walled hollow mandrel for rolling mills improved as follows:

a plurality of radial bores in said mandrel wall arranged regularly in an axial as well as in a circumferential direction;

a plurality of cooling fingers inserted in said bores and being composed of a good thermo-conductive material, said fingers having head portions respectively positioned in said radial bores in recessed relation to an outer surface of the mandrel; and a plurality of plugs of wear resistant metal which fill said recesses, said plugs comprising cladded layers of weld-deposited metal.

2. Mandrel as in claim 1, said fingers being composed of copper.

3. Mandrel as in claim 1, and including a buffering layer positioned between said finger and said plug, said layer being composed of a nickel-containing alloy.

4. Mandrel as in claim 1, said bores having widened portions near the outer surface of the mandrel, said head portions being widened corresponding to the widened portions of the bore and having a conical transition complementary to a corresponding conical transition surface extending between the bore and its widened portions.

5. Mandrel as in claim 1, said bores and fingers being arranged in axially extending rows, adjacent rows being staggered.

6. Mandrel as in claim 1, said fingers projecting into the internal space of the mandrel.

7. Mandrel as in claim 1, said bores and fingers being radially inwardly tapered.

8. Mandrel as in claim 1, including a buffering layer of a nickel copper alloy positioned between said finger and said cladding plug.

* * * * *